US009388820B2

(12) United States Patent
Kean et al.

(10) Patent No.: US 9,388,820 B2
(45) Date of Patent: Jul. 12, 2016

(54) HYDRAULIC MOTOR-DRIVEN BEARING LUBRICATION SYSTEM FOR A CENTRIFUGAL PUMP

(71) Applicant: Weir Minerals Australia, Ltd., Artarmon NSW (AU)

(72) Inventors: Jamie W. Kean, Macungie, PA (US); Gary Saylor, Sugarloaf, PA (US)

(73) Assignee: Weir Minerals Australia, Ltd. (AU)

( * ) Notice: Subject to any disclaimer, the term of this patent is extended or adjusted under 35 U.S.C. 154(b) by 433 days.

(21) Appl. No.: 14/018,685

(22) Filed: Sep. 5, 2013

(65) Prior Publication Data

US 2014/0064917 A1 Mar. 6, 2014

Related U.S. Application Data

(60) Provisional application No. 61/697,424, filed on Sep. 6, 2012.

(51) Int. Cl.

| | |
|---|---|
| ***F01D 11/00*** | (2006.01) |
| ***F01D 25/18*** | (2006.01) |
| ***F04D 29/08*** | (2006.01) |
| ***F04D 29/06*** | (2006.01) |
| ***F04D 13/08*** | (2006.01) |

(52) U.S. Cl.

CPC ..... *F04D 29/06* (2013.01); *F04D 13/08* (2013.01); *F04D 29/061* (2013.01); *F05D 2260/98* (2013.01)

(58) Field of Classification Search

CPC .... F04D 29/061; F04D 13/08; F05D 2260/98
USPC ..... 415/112, 111; 184/6.16, 6.18
See application file for complete search history.

(56) References Cited

U.S. PATENT DOCUMENTS

| | | | | |
|---|---|---|---|---|
| 2,234,777 | A * | 3/1941 | Puffer | F16N 13/22 184/6.16 |
| 5,069,603 | A | 12/1991 | Schuetz et al. | |
| 7,056,103 | B2 * | 6/2006 | LaRue | F01D 25/125 415/4.3 |
| 2006/0225419 | A1 * | 10/2006 | Prusinski | F01D 25/18 60/605.1 |
| 2009/0148088 | A1 | 6/2009 | Sasabe et al. | |
| 2011/0262068 | A1 | 10/2011 | Liu | |

FOREIGN PATENT DOCUMENTS

| | | | | |
|---|---|---|---|---|
| GB | 2029649 | A * | 3/1980 | F04D 13/06 |

* cited by examiner

*Primary Examiner* — Theresa Trieu
(74) *Attorney, Agent, or Firm* — Morriss O'Bryant Compagni

(57) ABSTRACT

A bearing lubrication system for a centrifugal pump includes a hydraulic recirculating pump that is structured to provide recirculation of a fluid to and from the motor that drives the impeller of the centrifugal pump, and a system of efferent and afferent conduits that are connected to both the motor and the bearing housing of the centrifugal pump to direct lubricating fluid to or from the bearings, and to or from the motor for recirculation to the hydraulic recirculating pump, thereby utilizing the lubricating fluid used to lubricate the drive motor as a means of lubricating and cooling the bearings that support the rotating shaft of the pump.

25 Claims, 2 Drawing Sheets

HYDRAULIC MOTOR-DRIVEN BEARING LUBRICATION SYSTEM FOR A CENTRIFUGAL PUMP

CROSS-REFERENCE TO RELATED APPLICATIONS

This non-provisional application claims priority to provisional patent application Ser. No. 61/697,424, filed Sep. 6, 2012.

TECHNICAL FIELD

This disclosure relates in general to centrifugal pumps and, in particular, to an improved system for lubricating the bearings of centrifugal pumps by employing the lubrication system of the pump motor.

BACKGROUND OF THE DISCLOSURE

Rotodynamic pumps are characterized in general by having a casing in which an impeller is positioned for rotation. The pump casing includes an inlet through which fluid enters the pump, and a discharge outlet through which fluid is discharged.

The impeller is operatively connected to a drive shaft that is rotationally driven by a motor which, in turn, imparts rotation to the impeller. The impeller is typically sealed from the casing by mechanical seal means that prevent fluid leakage from about the impeller and/or drive shaft and the pump casing.

The drive shaft is typically supported by a series of bearings that may have any number and type of constructions or configurations. The drive shaft typically extends through a bearing housing or support, which is structured to also maintain the bearings through which the drive shaft passes.

It is well known that the mechanical seals and bearings become heated from the friction induced by the rotation of the drive shaft and impeller relative to the bearings and seals. Therefore, it is necessary to keep the seals and bearings lubricated and cooled. This is conventionally accomplished by providing a coolant and/or lubricant to the bearings and seals, which can be accomplished in a variety of ways. For example, the bearings may conventionally be pre-packed with grease, and/or grease can be delivered through external ports in a bearing housing to keep the bearings lubricated.

SUMMARY

In a first aspect of the disclosure, embodiments are disclosed of a bearing lubrication system for a centrifugal pump which includes a hydraulic recirculating pump structured to provide recirculation of a fluid to and from a centrifugal pump, an efferent system of conduits connected to and extending away from the hydraulic recirculating pump, an afferent system of conduits connected to the hydraulic recirculating pump, a motor having a rotating shaft for operative connection to an impeller of a centrifugal pump, and bearings positioned to support the rotating shaft, where the bearings are in fluid communication with the motor, and wherein one of either the efferent system of conduits or the afferent system of conduits is connected to be in fluid communication with the bearings, and wherein the other of either the efferent system of conduits or the afferent system of conduits is connected to the motor. The bearing lubrication system of the disclosure is advantageous in utilizing the lubricating fluid from the hydraulic recirculating pump, which lubricates the motor, to also provide lubrication to the bearings of the rotating shaft, and advantageously recirculates the fluid from the bearings and the motor to the hydraulic recirculating pump for recirculation to the centrifugal pump.

In certain embodiments, the efferent system of conduits is in fluid communication with the bearings and the afferent system of conduits is connected to the motor.

In other embodiments, the efferent system of conduits further includes a fluid bifurcation device for directing fluid from the hydraulic recirculating pump to the motor and to the bearings.

In other embodiments, the efferent system of conduits further includes a first efferent conduit extending from the hydraulic pump to the bifurcation device, a second efferent conduit extending from the bifurcation device to provide fluid to the bearings and a third efferent conduit extending from the bifurcation device to the motor.

In yet another embodiment, the afferent system of conduits further includes a collector device structured to receive fluid from the motor and fluid directed from the bearings to the motor, and directs the combined fluids to the hydraulic recirculating pump.

In still another embodiment, the afferent system of conduits further includes a first afferent conduit extending from the collector device to the hydraulic recirculating pump, a second afferent conduit extending from the motor to the collector device and a third afferent conduit extending from an exit port for discharging accumulated fluid from the bearings to the collector device.

In another embodiment, the efferent system of conduits includes a pressure regulator for reducing the pressure of fluid entering from the hydraulic recirculating pump to the bearings.

In yet other embodiments of the bearing lubrication system, the efferent system of conduits is connected to the motor and the afferent system of conduits is in fluid communication with the bearings to direct fluid from the bearings to the hydraulic recirculating pump.

In still other embodiments, the afferent system of conduits further includes a collector device structured to receive fluid from the motor and fluid directed from the bearings, and to direct the combined fluids to the hydraulic recirculating pump.

In other embodiments, the afferent system of conduits further includes a first afferent conduit extending from the collector device to the hydraulic recirculating pump, a second afferent conduit extending from the motor to the collector device and a third afferent conduit extending from a port in fluid communication with the bearings for discharging accumulated fluid from the bearings to the collector device.

In other embodiments, the efferent system of conduits is connected to a pressure regulator for reducing the pressure of fluid entering from the hydraulic recirculating pump to the motor.

In a second aspect of the disclosure, a centrifugal pump having a bearing lubrication system includes a pump casing being sized to receive an impeller and having an inlet and a discharge, a motor having a rotating shaft that is operatively connected to the impeller of the pump, a bearing housing connected to the pump casing and to the motor, the bearing housing being configured with an inner bore through which the rotating shaft extends from the motor to the impeller, bearings positioned about the rotating shaft and located within the bore formed in the bearing housing, a hydraulic recirculating pump structured to provide recirculation of lubricating fluid to and from the motor, an efferent system of conduits connected to and extending away from the hydraulic recirculating pump, and an afferent system of conduits connected to the hydraulic pump for returning fluid from the centrifugal pump to the hydraulic recirculating pump, wherein one of either the efferent system of conduits or the afferent system of conduits is connected to be in fluid communication with the bearings, and wherein the other of either the efferent system of conduits or the afferent system of conduits is connected to the motor. This second aspect of the invention provides an advantageous arrangement for centrifugal pumps, particularly submersible pumps, by utilizing the lubricating fluid from a hydraulic recirculating pump that is used to cool the drive motor to also cool and lubricate the bearings supporting the rotating shaft, and to circulate the lubricating fluid back to the motor.

In one embodiment of the second aspect, the bearings include inboard bearings and outboard bearings.

In yet another embodiment of the second aspect, the efferent system of conduits further includes a fluid bifurcation device for directing fluid from the hydraulic recirculating pump to the motor and to the bearings.

In still another embodiment of the second aspect, the efferent system of conduits further includes a first efferent conduit extending from the hydraulic recirculating pump to the bifurcation device, a second efferent conduit extending from the bifurcation device to the bearing housing and a third efferent conduit extending from the bifurcation device to the motor.

In another embodiment of the second aspect, the afferent system of conduits further includes a collector device structured to receive fluid from the motor and fluid from the bearings to direct the combined fluids to the hydraulic recirculating pump.

In another embodiment of the second aspect, the afferent system of conduits further includes a first afferent conduit extending from the collector device to the hydraulic recirculating pump, a second afferent conduit extending from the motor to the collector device and a third afferent conduit extending from an exit port for discharging accumulated fluid from the bearings to the collector device.

In another embodiment of the second aspect, the efferent system of conduits includes a pressure regulator for reducing the pressure of fluid from the hydraulic recirculating pump before entering into the bearing housing.

In another embodiment of the second aspect, a port fitting is provided in the bearing housing to which the second efferent conduit is connected to deliver lubricating fluid to the bore of the bearing housing.

In yet another embodiment of the second aspect, the bearing housing is in fluid communication with the motor to direct lubricating fluid from the bore of the bearing housing to the motor.

In still another embodiment of the second aspect, the motor is configured with an exit port to which the afferent conduit system is attached to direct lubricating fluid, collected from the bearing housing, to the hydraulic recirculating pump for recirculation.

In another embodiment of the second aspect, mechanical seals are positioned between the rotating shaft and the pump casing and are positioned in fluid communication with the bore of the bearing housing to receive lubrication from the fluid provided from the hydraulic recirculating pump.

In still other embodiments of the second aspect, the efferent system of conduits is connected to the motor, which is in fluid communication with the bearing housing, to direct fluid to the motor and to the bearings.

In yet other embodiments of the second aspect, the efferent system of conduits is connected to a pressure reducer device to selectively reduce the pressure of the fluid entering into the motor.

In certain embodiments of the second aspect, the afferent system of conduits is connected to the bearing housing to direct fluid from the bearings to the hydraulic recirculating pump.

In certain other embodiments of the second aspect, the afferent system of conduits further includes a collector device, a first afferent conduit extending from the collector device to the hydraulic recirculating pump, a second afferent conduit extending from the motor to the collector device and a third afferent conduit extending from the bearing housing to the collector device for directing fluid from the bearing housing and motor to the hydraulic recirculating pump.

In yet another embodiment of the second aspect, the centrifugal pump is a submersible pump.

In a third aspect, methods of lubricating the bearings of a centrifugal pump include the steps of:

- providing a centrifugal pump having an impeller that is operatively connected to the rotating shaft of a motor, the rotating shaft extending through a central bore of a bearing housing that is positioned proximate the motor, and having bearings positioned within the central bore of the bearing housing to support the rotating shaft;
- providing a hydraulic recirculating fluid pump in fluid communication with the motor and bearing housing via a system of efferent and afferent conduits;
- pumping lubricating fluid from the hydraulic recirculating pump, through the efferent system of conduits, to the motor and to the bearing housing;
- directing the lubricating fluid into the central bore of the bearing housing to lubricate the bearings located within the bearing housing;
- directing the lubricating fluid, collected in the motor and from the bearing housing, into the afferent system of conduits;
- directing the lubricating fluid through the afferent conduit system to the hydraulic recirculating pump for recirculation of the lubricating fluid to the motor and bearing housing through the efferent conduit system.

In another embodiment of the third aspect, the methods further include directing the lubricating fluid from the central bore of the bearing housing into the motor, with which the bearing housing is in fluid communication.

In yet other embodiments of the third aspect, the methods include an additional step of reducing the pressure of the lubricating fluid in the efferent conduit system prior to directing the lubricating fluid into the motor or bearing housing.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments, in which.

DETAILED DESCRIPTION

Figure 1:
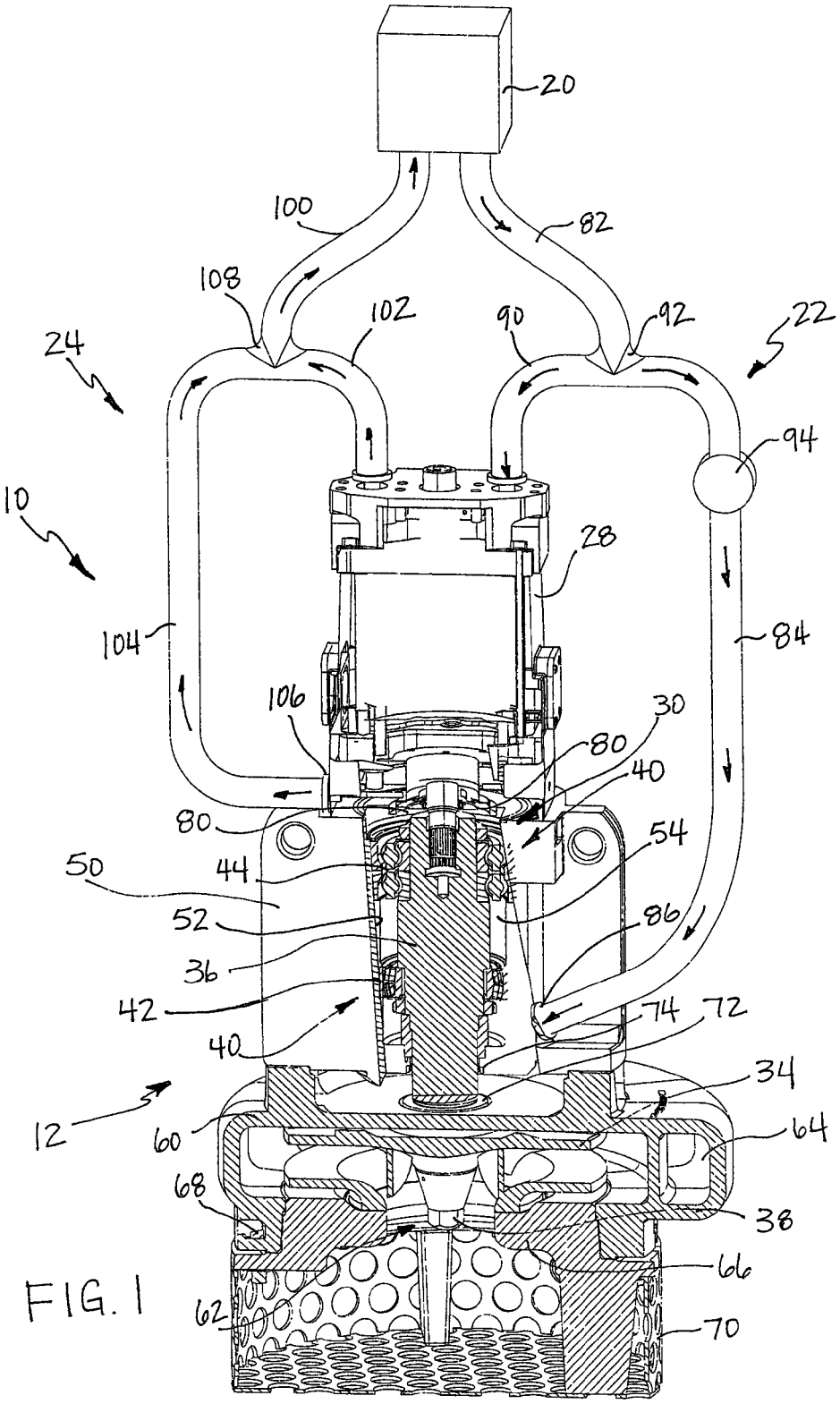
FIG. 1 is a view in elevation, and in partial cross section, which schematically illustrates the hydraulic motor-driven bearing lubrication system in accordance with this disclosure.

FIG. 1 illustrates schematically a first embodiment of a bearing lubrication system 10 for a centrifugal pump 12. The bearing lubrication system 10 generally comprises a hydraulic recirculating pump 20 that is structured to provide recirculation of a lubrication fluid to and from a centrifugal pump 12. An efferent system of conduits 22 is connected to and extends away from the hydraulic recirculating pump 20 to deliver lubricating fluid to parts of the centrifugal pump 12, as indicated by the arrows. An afferent system of conduits 24 is connected to the hydraulic recirculating pump 20 to direct lubricating fluid back to the hydraulic recirculating pump 20, as denoted by the arrows, from parts of the centrifugal pump 12.

More specifically, the efferent system of conduits 22 is connected to a motor 28 that has a drive mechanism 30 for operative connection to an impeller 34 of a centrifugal pump 12. It should be noted that the motor 28 shown schematically in FIG. 1 is merely representative of the operational components of a motor positioned within a motor housing, but the details of the operational components are not illustrated since they are well known in the art. The schematic illustration of the motor 28 may be considered as being more representative of a motor housing, though referred to herein as "the motor." The structure of the motor or motor housing is not intended to be limited by lack of illustration since motors of this type are well-known in the art.

As illustrated, in many pump arrangements, the drive mechanism 30 is comprised of a rotating shaft 36 that is operatively driven by the motor 28 and connected to the impeller 34, typically by threaded connection to an impeller hub nut 38. It should be noted that the rotating shaft 36, in some arrangements, may be a drive shaft that extends from the motor 28 to a pump shaft or to the impeller, while in other arrangements, the rotating shaft 36 may be a pump shaft that is connected to the drive shaft of the motor, the pump shaft being connected to the impeller 34. Thus, "rotating shaft," as used herein, may refer to either a drive shaft, in certain arrangements, or a pump shaft, in other arrangements.

Bearings 40 are positioned to support the rotating shaft 36 in its rotation. The bearings 40 may be of any construction or configuration that is appropriate to the centrifugal pump arrangement. Typically, however, and as illustrated, the bearings 40 may be further comprised of inboard bearings 42 and outboard bearings 44 which are axially spaced apart from each other along the length of the rotating shaft 36.

The bearings 40 are maintained within a bearing housing 50 that is generally configured with a central bore 52 which provides an annular space 54 about the rotating shaft 36. The bearings 40 are located in the annular space 54 and are positioned to span between the bearing housing 50 and the rotating shaft 36 to thereby support the rotating shaft 36 within the central bore 52 of the bearing housing 50.

The bearing housing 50 is secured to the pump casing 60 of the centrifugal pump 12. The type and configuration of centrifugal pump may vary widely. By way of example, however, the pump casing 60 of the illustrated centrifugal pump 12 is configured to house the impeller 34, and is further structured with an inlet 62 and a discharge outlet 64. A throatbush 66, which is shown in this particular pump configuration as part of a strainer device 70, may define the inlet 62 of the pump casing 60. The throatbush 66 is attached to the pump casing 60 by bolts 68 in known fashion.

The bearing housing 50 is secured to the pump casing by bolts (not shown) in known fashion. A plurality of seals may typically be positioned between the rotating shaft 36, the bearing housing 50 and the pump casing 60 to provide a fluid-tight seal between the three components. Thus, a radial seal 72 is illustrated being positioned between the pump casing 60 and the bearing housing 50 to provide a seal therebetween. Mechanical seals 74 are also positioned between the rotating shaft 36 and the bearing housing 50 to provide a seal between the rotating shaft 36 and the bearing housing 50. It can be seen that the mechanical seals 74 are positioned in proximity to the annular space 54 provided by the central bore 52 of the bearing housing 50. The mechanical seals 74 are particularly selected to operate efficiently when fluid from the hydraulic recirculating pump 20 is the lubricating fluid.

As further illustrated in FIG. 1, the motor 28 is mounted, in this particular configuration, to the bearing housing 50 such that the bearing housing 50 is positioned between the pump casing 60 and the motor 28. The motor 28 is secured to the bearing housing 50 by bolts (not shown). The motor 28 is structured with apertures 80 that align with the central bore 52 of the bearing housing 50, thereby providing fluid communication between the annular space 54 of the bearing housing 50 and the motor 28.

The bearing lubrication system 10 that is shown in FIG. 1 is further configured with an efferent system of conduits 22 and an afferent system of conduits 24 to provide recirculation of lubrication fluid to and from the motor 28. In accordance with the disclosure, the efferent system of conduits 22 is also structured and configured to provide lubricating fluid to the bearings 40 to cool and lubricate the bearings 40, which become heated due to the friction created by rotation of the rotating shaft 36.

Thus, the efferent system of conduits 22 is structured with a first efferent conduit 82 which is connected to the hydraulic recirculating pump 20 to direct lubrication fluid away from the hydraulic recirculating pump 20. A second efferent conduit 84 transports lubrication fluid toward the bearings 44 by connection to the bearing housing 50 by means of a port fitting 86 connected to the bearing housing 50. The port fitting 86 is in fluid communication with the bearing housing 50 and leads to the annular space 54 therein.

A third efferent conduit 90 transports lubrication fluid from the hydraulic recirculating pump to the motor 28. In one embodiment, the first efferent conduit 82 may be connected to a bifurcation device 92, to which the second efferent conduit 84 and third efferent conduit 90 are also attached. The bifurcation device 92 is structured to provide divergent flow of lubrication fluid entering into the bifurcation device 92 from the first efferent conduit 82 into a split flow of lubrication fluid directed to both the second efferent conduit 84 and the third efferent conduit 90.

The efferent system of conduits 22 may, in another embodiment, include a pressure reducer 94 attached to the second efferent conduit 84 to reduce the pressure of the lubrication fluid before the lubrication fluid enters into the port fitting 86 and annular space 54 of the bearing housing 50, since the pressure of the lubrication fluid is under a certain degree of pressure provided by the hydraulic recirculating pump 20.

The afferent system of conduits 24 is configured and structured to transport back to the hydraulic recirculating pump 20 lubrication fluid that has been directed to the motor 28 for cooling, as well as lubrication fluid that has been direct to the bearings 40, as described more fully hereinafter. The afferent system of conduits 24, therefore, in one embodiment, is further comprised of a first afferent conduit 100 that is connected to the hydraulic recirculating pump 20 to transport lubrication fluid back to the hydraulic recirculating pump 20 for recirculation therethrough.

A second afferent conduit 102 is connected to the motor 28 and is in fluid communication with the first afferent conduit 100 to transport lubrication fluid from the motor 28 to the hydraulic recirculating pump 20.

A third afferent conduit 104 is connected to the motor 28, via an exit port 106 that is positioned in closer proximity to the bearing housing 50, and is in fluid communication with the first afferent conduit 100 to transport lubrication fluid back to the hydraulic recirculating pump 20. The positioning of the exit port 106 relative to the motor housing 28 is an important element to provide optimum pressurization conditions in the motor housing (e.g., to keep the motor housing and motor from over-pressuring). Improper placement of the exit port 106 may lead to improper motor function.

In one embodiment, the afferent system of conduits 24 is further structured with a collector device 108 that is connected to the first afferent conduit 100, and which is structured to provide connection of the second afferent conduit 102 and the third afferent conduit 104 thereto. The collector device 108 is structured to direct the flow of lubrication fluid from the second afferent conduit 102, and direct the flow of lubrication fluid from the third afferent conduit 104, to converge into a flow of lubrication fluid that is then transported by the first afferent conduit 100 to the hydraulic recirculating pump 20.

As illustrated by the directional arrows in FIG. 1, lubrication fluid is pumped by the hydraulic recirculating pump 20 through the efferent conduit system 22 to provide lubrication fluid to both the motor 28, via the third efferent conduit 90, and to the annular space 54 of the bearing housing 50, via the second efferent conduit 84. The lubrication fluid enters into the annular space 54 and travels through the annular space 54 to lubricate and cool both the inboard bearings 42 and the outboard bearings 44, as well as the mechanical seals 74.

The lubrication fluid then flows through the openings 80 from the annular space 54 into the motor 28 to provide further lubrication to the motor 28. The positioning of the exit port 106 of the motor 28 near the bearing housing 50 and the openings 80 provides an immediate pathway for direction and transport of lubrication fluid away from the motor 28, particularly that fluid which has been received into the motor 28 from the annular space 54. Concurrently, lubrication fluid is directed away from the motor 28 through the second afferent conduit 102 and toward the collector device 108 for confluence with the lubrication fluid being transported by the third afferent conduit 104 toward the hydraulic recirculating pump 20. Thus, lubrication fluid pumped by the hydraulic recirculating pump 20 to the motor 28 and to the bearings 40 is transported back to the hydraulic recirculating pump 20 for recirculation of the lubrication fluid in a constant loop.

In another aspect, the method of circulating fluid to the annular space 54 of the bearing housing 50 may include reducing the pressure of the fluid in the second efferent conduit 84 by operation of the pressure reducer 94 prior to the lubrication fluid entering into the annular space 54 via the port fitting 86.

Figure 2:
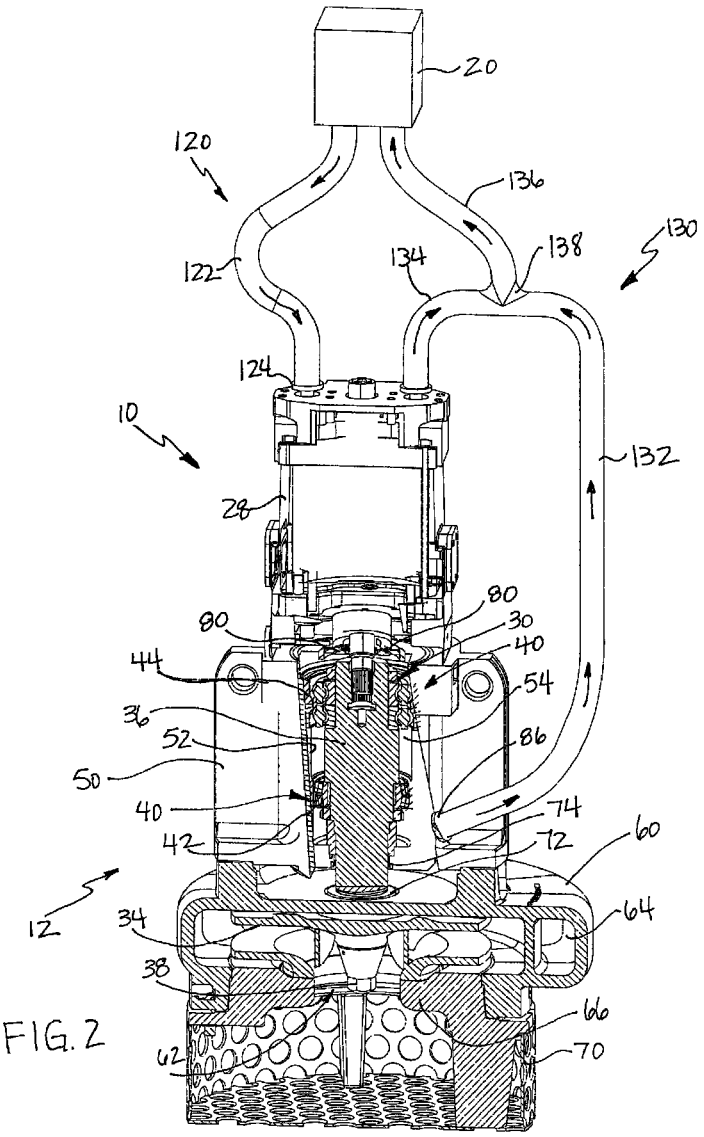
FIG. 2 is a view in elevation, and in partial cross section, which schematically illustrates an alternative embodiment of a hydraulic motor-driven bearing lubrication system in accordance with the disclosure.

An alternative embodiment of the bearing lubrication system is shown in FIG. 2, where like parts are designated with like reference numerals. In the embodiment shown in FIG. 2, the hydraulic recirculating pump 20 is structured with an efferent system of conduits 120 comprising an efferent conduit 122 that extends from the hydraulic recirculating pump 20 to the motor 28. This is a particularly advantageous arrangement with respect to certain motor and motor housing arrangements where lubricating fluid that is directed from the hydraulic recirculating pump 20 to the motor 28 is able to move by means, such as gravity, toward the bearings 40 in the bearing housing 50. This may be accomplished, for example, by movement of the lubricating fluid through the apertures 80 into the annular space 54 about the rotating shaft 36. The lubricating fluid can, therefore, contact and lubricate the bearings 40 and the mechanical seals 74.

The efferent conduit 122 may, in one embodiment, be connected to the motor 28 in communication with a pressure reducer 124 that reduces the pressure of the fluid as it inters into the motor 28.

Lubricating fluid, in this embodiment, accumulates at a lower point of the bearing housing 50. Thus, the embodiment is provided with an afferent system of conduits 130 which directs lubricating fluid from the bearings to the hydraulic recirculating pump 20. The afferent system of conduits 130 may include an afferent conduit that extends from the bearings 40, via the bearing housing 50, toward the hydraulic recirculating pump 20.

The afferent system of conduits 130 may further include an afferent conduit that directs lubricating fluid from the motor 28 back to the hydraulic recirculating pump 20. In such embodiments, the afferent system of conduits 130 may include a collector 138 device that is connected to the hydraulic recirculating pump 20 by a first afferent conduit 136. The collector device 138 is also positioned to receive fluid from a second afferent conduit 132 and the third afferent conduit 134 and directs the confluence of fluid streams into the first afferent conduit 136, which delivers fluid back to the hydraulic recirculating pump 20. Fluid collected into the hydraulic recirculating pump 20 is then recirculated back to the centrifugal pump, namely the motor 28, through the efferent conduits 122, and so forth.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, inventions have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A bearing lubrication system for a centrifugal pump, comprising:

a hydraulic recirculating pump structured to provide recirculation of a fluid to and from the centrifugal pump;

an efferent system of conduits connected to and extending away from the hydraulic recirculating pump;

an afferent system of conduits connected to the hydraulic recirculating pump;

a motor having a rotating shaft for operative connection to an impeller of the centrifugal pump;

bearings positioned to support the rotating shaft, the bearings being in fluid communication with the motor; and wherein one of either said efferent system of conduits or said afferent system of conduits is connected to be in fluid communication with the bearings, and wherein the other of either said efferent system of conduits or said afferent system of conduits is connected to the motor.

2. The bearing lubrication system of claim 1, wherein said efferent system of conduits is in fluid communication with the bearings and the afferent system of conduits is connected to the motor.

3. The bearing lubrication system of claim 2, wherein the efferent system of conduits further includes a fluid bifurcation device positioned to direct fluid from the hydraulic recirculating pump to the motor and to the bearings.

4. The bearing lubrication system of claim 3, wherein the efferent system of conduits further includes a first efferent conduit extending from the hydraulic recirculating pump to the fluid bifurcation device, a second efferent conduit extending from the fluid bifurcation device to provide fluid to the bearings and a third efferent conduit extending from the fluid bifurcation device to the motor.

5. The bearing lubrication system of claim 2, wherein the afferent system of conduits further includes a collector structured to receive fluid from the motor and fluid directed from the bearings to the motor, and to direct the combined fluids to the hydraulic recirculating pump.

6. The bearing lubrication system of claim 5, wherein the afferent system of conduits further includes a first afferent conduit extending from the collector to the hydraulic recirculating pump, a second afferent conduit extending from the motor to the collector and a third afferent conduit extending from an exit port for discharging accumulated fluid from the bearings to the collector.

7. The bearing lubrication system of claim 2, wherein the efferent system of conduits includes a pressure regulator for reducing the pressure of fluid entering from the hydraulic recirculating pump to the bearings.

8. The bearing lubrication system of claim 1, wherein said efferent system of conduits is connected to the motor and said afferent system of conduits is in fluid communication with the bearings to direct fluid from the bearings to the hydraulic recirculating pump.

9. The bearing lubrication system of claim 8, wherein the afferent system of conduits further includes a collector structured to receive fluid from the motor and fluid directed from the bearings, and to direct the combined fluids to the hydraulic recirculating pump.

10. The bearing lubrication system of claim 9, wherein the afferent system of conduits further includes a first afferent conduit extending from the collector to the hydraulic recirculating pump, a second afferent conduit extending from the motor to the collector and a third afferent conduit extending from a port in fluid communication with the bearings for discharging accumulated fluid from the bearings to the collector.

11. The bearing lubrication system of claim 8, wherein the efferent system of conduits is connected to a pressure regulator for reducing the pressure of fluid entering from the hydraulic recirculating pump to the motor.

12. A centrifugal pump having a bearing lubrication system, comprising:

a pump casing being sized to receive an impeller and having an inlet and a discharge;

a motor having a rotating shaft that is operatively connected to the impeller of the pump;

a bearing housing connected to the pump casing and to the motor, the bearing housing being configured with an inner bore through which the rotating shaft extends from the motor to the impeller;

bearings positioned about the rotating shaft and located within the bore formed in the bearing housing;

a hydraulic recirculating pump structured to provide recirculation of lubricating fluid to and from the motor;

an efferent system of conduits connected to and extending away from the hydraulic recirculating pump; and an afferent system of conduits connected to the hydraulic recirculating pump for returning fluid from the centrifugal pump to the hydraulic recirculating pump, wherein one of either said efferent system of conduits or said afferent system of conduits is connected to be in fluid communication with the bearings, and wherein the other of either said efferent system of conduits or said afferent system of conduits is connected to the motor.

13. The centrifugal pump of claim 12, wherein the efferent system of conduits further includes a fluid bifurcation device positioned to direct fluid from the hydraulic recirculating pump to the motor and to the bearings.

14. The centrifugal pump of claim 13, wherein the efferent system of conduits further includes a first efferent conduit extending from the hydraulic recirculating pump to the fluid bifurcation device, a second efferent conduit extending from the fluid bifurcation device to the bearing housing and a third efferent conduit extending from the fluid bifurcation device to the motor.

15. The centrifugal pump of claim 14, wherein the afferent system of conduits further includes a collector structured to receive fluid from the motor and fluid collected from the bearings to direct the combined fluids to the hydraulic recirculating pump.

16. The centrifugal pump of claim 15 wherein the afferent system of conduits further includes a first afferent conduit extending from the collector to the hydraulic recirculating pump, a second afferent conduit extending from the motor to the collector and a third afferent conduit extending from an exit port for discharging accumulated fluid from the bearings to the collector.

17. The centrifugal pump of claim 12, wherein the efferent system of conduits includes a pressure regulator for reducing the pressure of fluid from the hydraulic recirculating pump before entering into the bearing housing.

18. The centrifugal pump of claim 12, wherein the efferent system of conduits is connected to the motor, which is in fluid communication with the bearing housing, to direct fluid to both the motor and the bearings.

19. The centrifugal pump of claim 18, wherein the efferent system of conduits is connected to a pressure reducer to selectively reduce the pressure of the fluid entering into the motor.

20. The centrifugal pump of claim 18, wherein the afferent system of conduits is connected to the bearing housing to direct fluid from the bearings to the hydraulic recirculating pump.

21. The centrifugal pump of claim 20, wherein the afferent system of conduits further includes a collector, a first afferent conduit extending from the collector to the hydraulic recirculating pump, a second afferent conduit extending from the motor to the collector and a third afferent conduit extending from the bearing housing to the collector for directing fluid from the bearing housing and motor to the hydraulic recirculating pump.

22. The centrifugal pump of claim 12, wherein the centrifugal pump is a submersible pump.

23. A method of lubricating the bearings of a centrifugal pump, comprising:

providing a centrifugal pump having an impeller that is operatively connected to the rotating shaft connected to a motor, the rotating shaft extending through a central bore of a bearing housing that is positioned proximate the motor, and having bearings positioned within the central bore of the bearing housing to support the rotating shaft;

providing a hydraulic recirculating fluid pump in fluid communication with the motor and bearing housing via a system of efferent conduits and afferent conduits;

pumping lubricating fluid from the hydraulic recirculating pump, through the system of efferent conduits, to the motor and to the bearing housing;

directing the lubricating fluid into the central bore of the bearing housing to lubricate the bearings located with the bearing housing;

directing the lubricating fluid, collected in the motor and the bearing housing, into the system of afferent conduits;

directing the lubricating fluid through the system of afferent conduits to the hydraulic recirculating fluid pump for recirculation of the lubricating fluid to the motor and bearing housing through the system of efferent conduits.

24. The method of claim 23 further including directing the lubricating fluid from the central bore of the bearing housing into the motor, with which the bearing housing is in fluid communication.

25. The method of claim 23 further comprising reducing the pressure of the lubricating fluid in the system of efferent conduits prior to the lubricating fluid entering the motor or bearing housing through the system of efferent conduits.

* * * * *